US008479713B2

(12) United States Patent
Wobben

(10) Patent No.: US 8,479,713 B2
(45) Date of Patent: Jul. 9, 2013

(54) METHOD FOR AVOIDING AND/OR REDUCING POLLUTANT PERCENTAGES IN THE EXHAUST GAS OF AN INTERNAL COMBUSTION ENGINE

(76) Inventor: Aloys Wobben, Aurich (DE)

( * ) Notice: Subject to any disclaimer, the term of this patent is extended or adjusted under 35 U.S.C. 154(b) by 169 days.

(21) Appl. No.: 12/810,005

(22) PCT Filed: Dec. 19, 2008

(86) PCT No.: PCT/EP2008/010954
§ 371 (c)(1),
(2), (4) Date: Aug. 10, 2010

(87) PCT Pub. No.: WO2009/083195
PCT Pub. Date: Jul. 9, 2009

(65) Prior Publication Data

US 2011/0011374 A1 Jan. 20, 2011

(30) Foreign Application Priority Data

Dec. 21, 2007 (DE) ..... 10 2007 063 064

(51) Int. Cl.
*F02M 27/06* (2006.01)

(52) U.S. Cl.
USPC ..... 123/538

(58) Field of Classification Search
USPC ..... 123/536–538
See application file for complete search history.

(56) References Cited

U.S. PATENT DOCUMENTS

| | | | | |
|---|---|---|---|---|
| 6,748,933 | B2 * | 6/2004 | Prevost | 123/538 |
| 7,568,474 | B2 * | 8/2009 | Rudolph et al. | 123/538 |
| 7,951,288 | B2 * | 5/2011 | Allen | 208/15 |
| 2002/0015674 | A1 | 2/2002 | Taniguchi et al. | |
| 2003/0001439 | A1 | 1/2003 | Schur | |
| 2003/0140903 | A1 * | 7/2003 | Smoot | 123/538 |
| 2003/0221678 | A1 * | 12/2003 | Kelemencky | 123/536 |
| 2005/0016508 | A1 * | 1/2005 | Monette et al. | 123/538 |
| 2005/0051144 | A1 * | 3/2005 | Champ et al. | 123/538 |
| 2005/0126160 | A1 | 6/2005 | Goldschmidt et al. | |
| 2005/0279332 | A1 * | 12/2005 | Zhang | 123/538 |
| 2007/0181104 | A1 * | 8/2007 | Collins | 123/537 |
| 2007/0272220 | A1 * | 11/2007 | Rozim | 123/538 |
| 2008/0006249 | A1 * | 1/2008 | Evangelista | 123/536 |

FOREIGN PATENT DOCUMENTS

| | | | |
|---|---|---|---|
| DE | 19512394 | A1 | 6/1996 |
| EP | 1179710 | A1 | 2/2002 |
| JP | 2002-520146 | | 7/2002 |
| WO | 00/03781 | | 1/2000 |
| WO | 0015957 | A1 | 3/2000 |
| WO | 0033954 | A1 | 6/2000 |
| WO | 0216024 | A1 | 2/2002 |
| WO | 02075144 | A1 | 9/2002 |

(Continued)

*Primary Examiner* — M. McMahon
(74) *Attorney, Agent, or Firm* — Seed IP Law Group PLLC

(57) ABSTRACT

The present application is directed to a method and an apparatus for avoiding and/or reducing pollutant percentages in the exhaust gas of an internal combustion engine. Before fuel passes into the combustion chamber of the internal combustion engine, it is exposed to electromagnetic signals. The electromagnetic signals including at least two signals at two preset frequencies, and are above 20 kHz. The electromagnetic signals are delivered by way of a transmission member that is disposed in a fuel treatment unit, which has a fuel feed line to a fuel tank and a fuel discharge line to the internal combustion engine.

13 Claims, 6 Drawing Sheets

FOREIGN PATENT DOCUMENTS

| | | | |
|---|---|---|---|
| WO | 2004025110 | A1 | 3/2004 |
| WO | 2005001274 | A1 | 1/2005 |
| WO | 2005012717 | A1 | 2/2005 |
| WO | 2007054701 | A1 | 5/2007 |

* cited by examiner

METHOD FOR AVOIDING AND/OR REDUCING POLLUTANT PERCENTAGES IN THE EXHAUST GAS OF AN INTERNAL COMBUSTION ENGINE

BACKGROUND

1. Technical Field

The disclosed subject matter concerns a method of avoiding and/or reducing pollutant percentages in the exhaust gas of an internal combustion engine and also an apparatus for reducing and/or avoiding pollutant percentages in the exhaust gas of an internal combustion engine.

2. Description of the Related Art

Apparatuses are known in the state of the art, by means of which environmentally damaging components in the exhaust gas can be reduced. For example, in the case of diesel vehicles, so-called soot filters are used to filter a part of the soot out of the exhaust gas produced upon combustion of diesel fuel. In the case of vehicles with Otto-cycle engines, so-called catalytic converters are known, in which pollutant components in the exhaust gas are reduced by chemical reactions. What is common to these solutions is that the combustion products are produced and then filtered or converted so as to be kept away from the environment.

The following documents represent a general state of the art: WO 00/33954 A, US No 2002/015674 A1; DE 195 12 394 A1; WO 2004/025110; and WO 02/16024 and WO 00/15957. The state of the art as disclosed in WO 00/33954 purportedly teaches a method of preparing or treating fluids by means of electroacoustic signals. The document also mentions, inter alia, designing an electroacoustic signal generator which generates a first signal on the order of magnitude of 1.1 kHz and a second signal on the order of magnitude of 1.5 kHz. The generated electroacoustic signals are supplied by way of an antenna around which the fuel flows before being fed into the internal combustion engine. The method disclosed in WO 00/33954 is intended to increase the octane number of the fuel by an increase of 5%.

BRIEF SUMMARY

It is an object of the presently disclosed subject matter to at least reduce the occurrence of pollutants, in particular soot particles, during the combustion process in an internal combustion engine.

The disclosed subject matter is based on the realization that, for example, the soot which is produced in a combustion process can admittedly be trapped (e.g., by filtering) as it inevitably occurs. The trapped soot also has to be eliminated in an environmentally acceptable fashion. An example of which is a catalytic converter, which causes chemical changes in the exhaust gas of the internal combustion engine by reacting on pollutants that have already occurred.

It is desirable, however, to not even allow such pollutants to occur at all, or if they do occur, then to limit their occurrence in a considerably reduced degree upon combustion.

According to a preferred embodiment of the disclosed subject matter, pollutants can be reduced in part to a degree by the disclosed method and also by the disclosed apparatus without having to implement a major modification on the internal combustion engine.

Fine dust, which is produced upon operation of an internal combustion engines, as is the production of other pollutants, for example nitrogen oxides, carbon dioxides, hydrogen sulfides, etc. (the usual gaseous compositions of exhaust gases), increasingly represents not only a direct threat to human health, but also impacts climate change. The disclosed subject matter seeks a method and apparatus that reduces, by quite a considerable extent, at least certain combustion products, such as fine dust and other pollutants. The fuel consumption of the internal combustion engine can also be reduced by the disclosed method and apparatus.

According to a preferred embodiment of the disclosed subject matter, there is a system that has a fuel tank that stores and delivers fuel to a fuel treatment unit, which houses a transmission member. The system further has an electromagnetic signal generator that generates electromagnetic signals and delivers them to the transmission member, which exposes the fuel in the fuel treatment unit to the electromagnetic signals. The system further has an engine that receives and uses the treated fuel.

BRIEF DESCRIPTION OF THE SEVERAL VIEWS OF THE DRAWINGS

The disclosed subject matter is described in greater detail hereinafter by means of examples set out in the figures.

DETAILED DESCRIPTION

Figure 1:
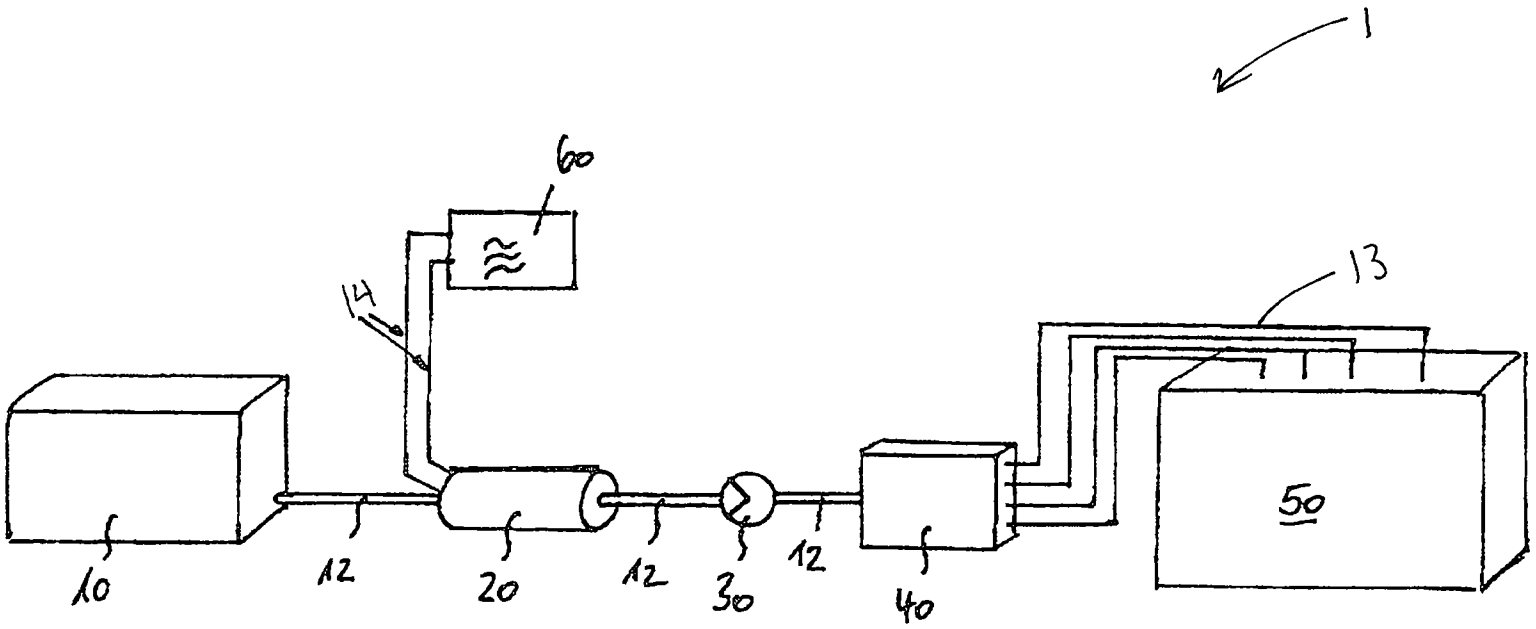
FIG. 1 shows a diagrammatic view of an internal combustion engine system according to the disclosed subject matter.

FIG. 1 shows a diagrammatic view of an internal combustion engine 1 according to the disclosed subject matter. The internal combustion engine 1 has a tank 10 for receiving fuel, from which a fuel line 12 runs to a fuel treatment unit 20. From fuel treatment unit 20 the fuel line 12 further goes to the fuel pump 30 and from there to the injection pump 40. The injection pump 40 makes the fuel available to the engine 50 by way of injection lines 13, the fuel is then burnt in the engine 50. It will be appreciated that the fuel pump 30 can also be disposed between the tank 10 and the fuel treatment unit 20 to convey the fuel.

There is further provided a frequency generator 60, which by way of lines 14 transmits electromagnetic signals to the fuel treatment unit 20, including transmission members (e.g., antennas) (not shown) arranged within the fuel treatment unit 20. The electromagnetic signals having preset frequencies and having adequate amplitude, the electromagnetic signals under some circumstances suitably amplified by means of an amplifier. The frequency generator 60 generates a multiplicity of different discrete frequencies, preferably between two and twenty-five.

In a first embodiment, there are more than four frequencies. In a second embodiment, there are more than five frequencies.

In a third embodiment, there are more than six frequencies. In a fourth embodiment, there are more than seven frequencies. In a fifth embodiment, there are more than eight frequencies. In a sixth embodiment, there are more than nine frequencies. In a seventh embodiment, there are more than 10 frequencies. In an eighth embodiment, there are more than 11 frequencies. In a ninth embodiment, there are more than 12 frequencies. In a tenth embodiment, there are more than 13 frequencies. In an eleventh embodiment, there are more than 14 frequencies. In a twelfth embodiment, there are more than 15 frequencies. In a thirteenth embodiment, there are more than 16 frequencies. In a fourteenth embodiment, there are more than 17 frequencies. In a fifteenth embodiment, there are more than 18 frequencies. In a sixteenth embodiment, there are more than 19 frequencies. In a seventeenth embodiment, there are more than 20 frequencies. In an eighteenth embodiment, there are more than 21 frequencies. In a nineteenth embodiment, there are more than 22 frequencies. In a twentieth embodiment, there are more than 23 frequencies. In a twenty-first embodiment, there are more than 24 frequencies. And in a twenty-second embodiment, there are more than 25 frequencies.

In a preferred embodiment, there are 18 frequencies. As an example of such frequencies, 18 sine signals having the following frequency values may be generated: 21.33 kHz, 23.55 kHz, 25.55 kHz, 26.66 kHz, 27.73 kHz, 30.23 kHz, 30.44 kHz, 34.33 kHz, 42.22 kHz, 44.11 kHz, 48.35 kHz, 49.11 kHz, 52.33 kHz, 54.33 kHz, 57.78 kHz, 63.33 kHz, 65.11 kHz, and 66.66 kHz.

In an alternative embodiment, there are 19 frequencies. For example, the 19 sine signals generated have the following frequency values: 21.33 kHz, 23.55 kHz, 25.55 kHz, 26.32 kHz, 26.66 kHz, 27.73 kHz, 30.23 kHz, 30.44 kHz, 34.33 kHz, 42.22 kHz, 44.11 kHz, 48.35 kHz, 49.11 kHz, 52.33 kHz, 54.33 kHz, 57.78 kHz, 63.33 kHz, 65.11 kHz, and 66.66 kHz.

Preferably transverse waves are transmitted with the foregoing sine signal frequencies. In an alternative embodiment, both transverse and longitudinal waves are transmitted with the foregoing sine signal frequencies. The disclosed subject matter is not limited to the above-mentioned frequency values, however, and can certainly be carried into effect using other frequency values.

The fuel coming from the tank 10 thus flows by way of the fuel line 12 into the fuel treatment unit 20. The fuel in the fuel treatment unit 20 is acted upon with the electromagnetic signals produced by the frequency generator 60, for example, at the specified frequencies listed above. The acted upon fuel is then transported by way of the next fuel line 12 and the fuel pump 30 to the injection pump 40. The injection pump 40 transports the treated fuel by way of injection lines 13 into the engine 50. The fuel is then burnt in engine 50 resulting in a reduced pollutant development so that the exhaust gases discharged by the engine 50 contain less pollutant percentages than exhaust gases of an internal combustion engine with a conventional fuel feed and without the need for further post-treatment.

The above-described principles can be applied to any desired internal combustion engine, that is to say for example, in not only a diesel engine but also an Otto-cycle engine, or the like. Such internal combustion engines can be used both in vehicles and also in ships. The above-described principles can also be used in static internal combustion engines, such as for example, in the case of a diesel generator. For that purpose, it is only necessary for the fuel treatment unit 20 to be arranged around a fuel line. The electromagnetic signals at different frequencies are applied to the antennas in the fuel treatment unit 20 so that the fuel flowing through the fuel line is influenced by the electromagnetic signals generated by the antennas.

The above-described principles can thus be used in relation to any internal combustion engine which receives fuel fed by way of a fuel line, or that receives fuel without injection.

The signals from the frequency generator 60 can be applied to the transmission members continuously, at fixed time intervals (e.g., every 5 through 10 seconds for 2 to 5 seconds in each case), or in random time intervals. For example, the cycle length can be in the range of 5 to 10 seconds and the duty cycle can vary from 20% to 100%, with a preferred duty cycle of 50% or higher. Thus for each 5 second cycle, the on time can range from 2 to 5 seconds, with 3 to 4 seconds also being possible. Alternatively, the time cycles can have a length that varies over the range of 2 to 10 seconds, and may occur in a random sequence. The duty cycle for each random sequence can vary from 50% to 100%.

Figure 2:
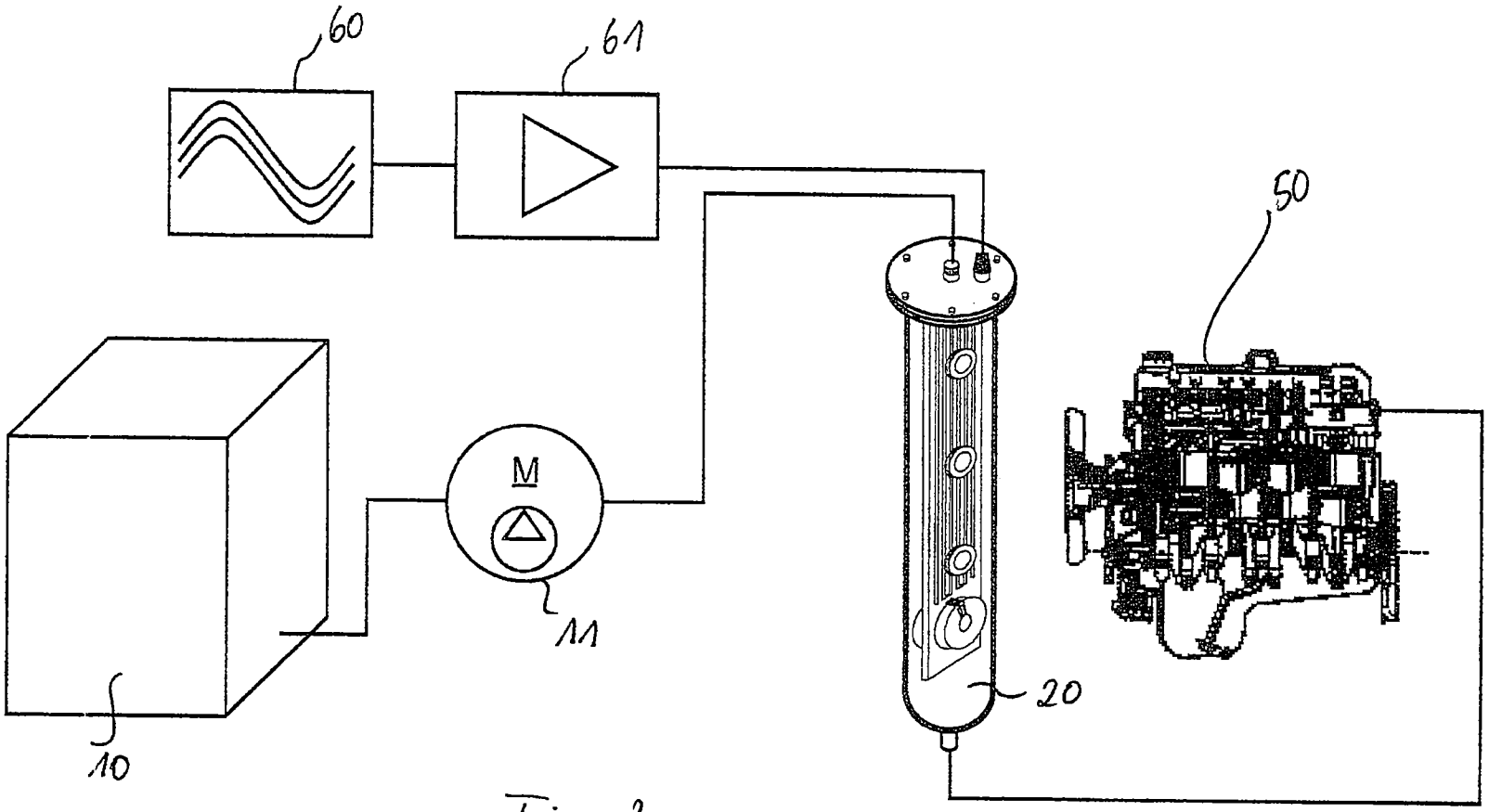
FIG. 2 shows a block diagram of components used in a fuel treatment system according to the disclosed subject matter.

FIG. 2 shows a block diagram of a fuel treatment according to the disclosed subject matter. There is the fuel treatment unit 20 arranged between the engine 50 and the fuel tank 10. In this case the fuel from the fuel tank 10 is preferably pumped to the fuel treatment unit 20 by way of a fuel pump 11. The frequency generator 60 generates sine wave signals that are set to the desired amplitude/power by means of an amplifier 61.

Figure 3:
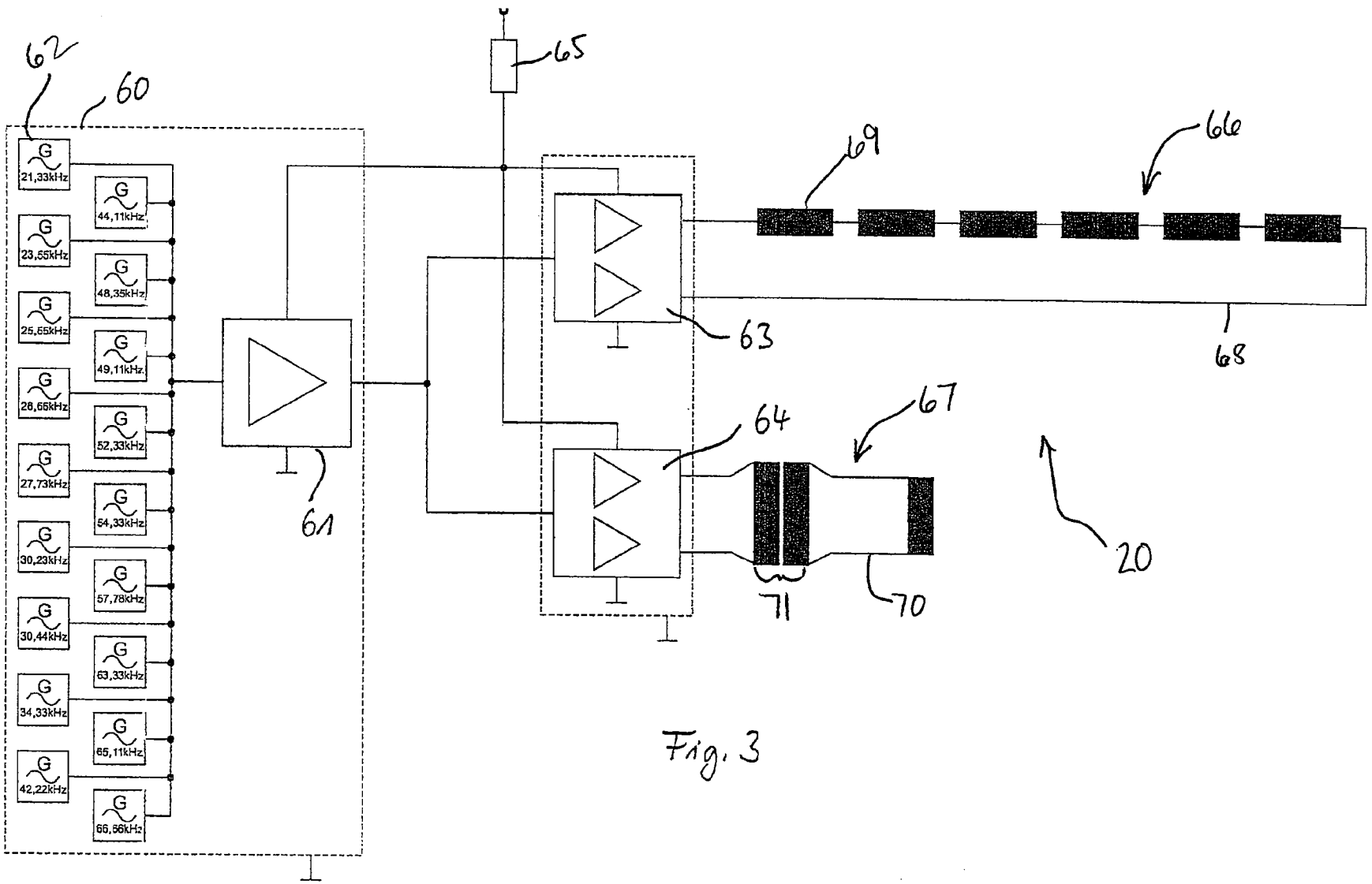
FIG. 3 shows an electrical block circuit diagram of the fuel treatment according to the disclosed subject matter.

FIG. 3 shows an electrical circuit diagram of the frequency generator 60 and the fuel treatment unit 20 connected thereto. As can be seen, the frequency generator 60 generates various electrical frequencies, preferably sine signals, from respective frequency generation blocks 62. The generated frequencies are amplified by the preamplifier 61 and then fed respectively to two further amplifiers 63 and 64. The amplifiers 63 and 64 in FIG. 3 each have two channels, effectively making a four-channel amplifier. There is also a voltage supply 65, for example, at 12 volts, that serves as the power supply to the entire electrical circuit diagram in FIG. 3.

Arranged downstream of the amplifiers 63 and 64 are transmission members 66 and 67, namely downstream of the amplifier 63 a transmission member 66 in the form of an electric line 68, which by virtue of the formation of a turn in the line 68 also forms a coil. There are also, preferably six individual coils 69 along the line 68. By way of example, it should be mentioned that the number of turns of the respective coils 69 can be 30 or also can obviously assume a different order of magnitude in the range, for example, of between 5 and 100 turns. It is also possible for the number of turns of the individual coils 69 to differ from each other.

Arranged downstream of the amplifier 64 is a line 70, which is set out in a flat plane and which in turn is connected to the amplifier by a transmission member, such as a transformer 71. The transformer 71 has a number of coils on the input side that is markedly higher than on the output side. Preferably the turn ratio in the transformer 71 is 13:1, but can also assume a different order of magnitude, for example 5:1 or also 55:1.

Figure 4:
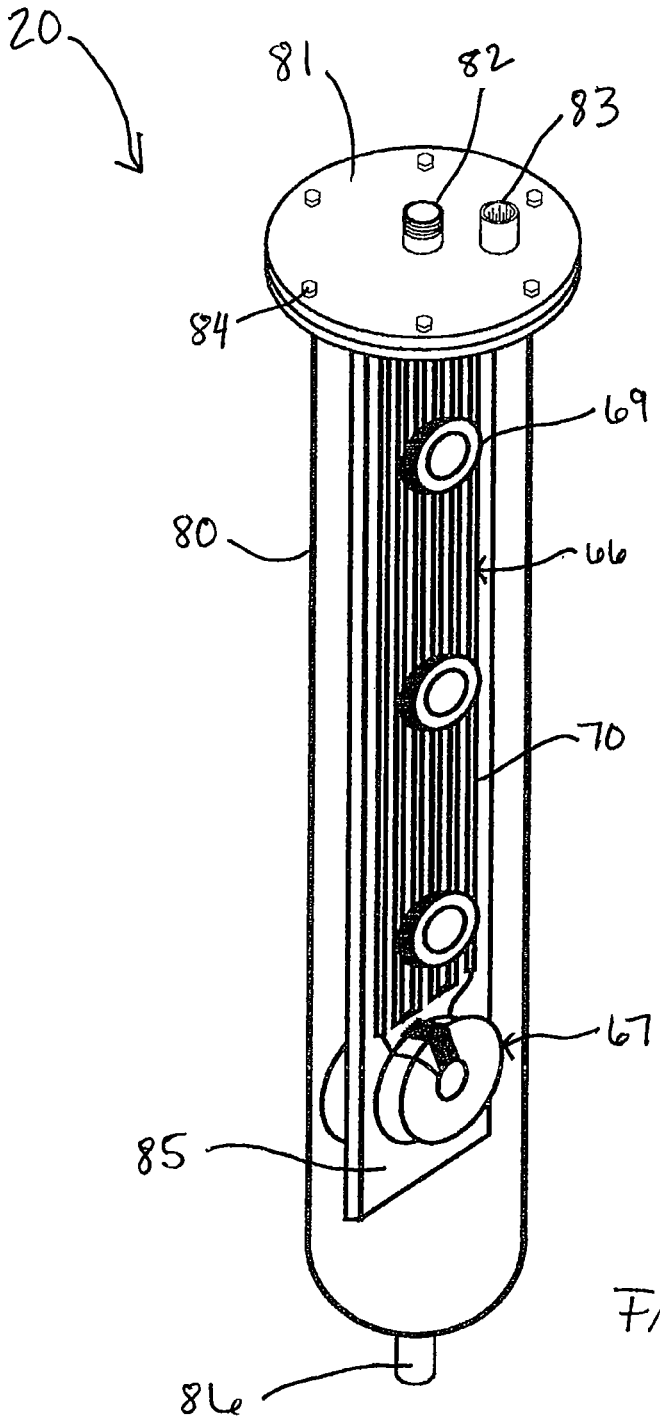
FIG. 4 shows the electromechanical structure of a fuel treatment unit according to the disclosed subject matter.

FIG. 4 now shows the electromechanical structure of the fuel treatment unit 20. It comprises a substantially hollow-cylindrical body 80 and is closed at one end with a cover 81 provided with a connection 82 for a hose from the fuel tank 10. The cover 81 also has a plug 83 for the electrical connection of the transmission members 66 and 67, which may function as antennas disposed in the fuel treatment unit 20, to the frequency generator 60.

The cover 81 is preferably provided with a fuel-resistant seal (not shown) and is fastened to the hollow-cylindrical body 80 by fasteners 84, or fixed thereto in some other fashion. The housing of the hollow-cylindrical body 80 is preferably made of high-quality steel, for example, having a 2.5 mm thickness and a flange welded thereto. The hollow-cylindrical body 80 has a volume that should be on the order of magnitude of between 0.3 and 5 liters, preferably being about 1.5 liters.

The coils 69 are preferably provided with a ferrite core. The line 70 comprises a steel sheet. Other metals or electrically conducting materials can also be used to achieve the purpose of the line 70 and steel sheet.

The fuel treatment unit 20 is provided with a liner cavity 85 surrounding the transmission members 66 and 67. The liner cavity 85 prevents direct contact between the electrically conducting parts of the transmission members 66 and 67 and the fuel in the hollow-cylindrical body 80. The liner cavity 85 can be formed, for example, by a GRP lamination which in turn not only protects the electrically conducting parts of the transmission members 66 and 67 from contact with the fuel, but also provides for stabilization of the overall fuel treatment unit 20.

Finally, the fuel treatment unit 20 has an output 86 at the opposite end of the fuel treatment unit 20 as the cover 81. The output 86 may be, for example, a hose connection capable of passing fuel to the engine 50.

Figure 5:
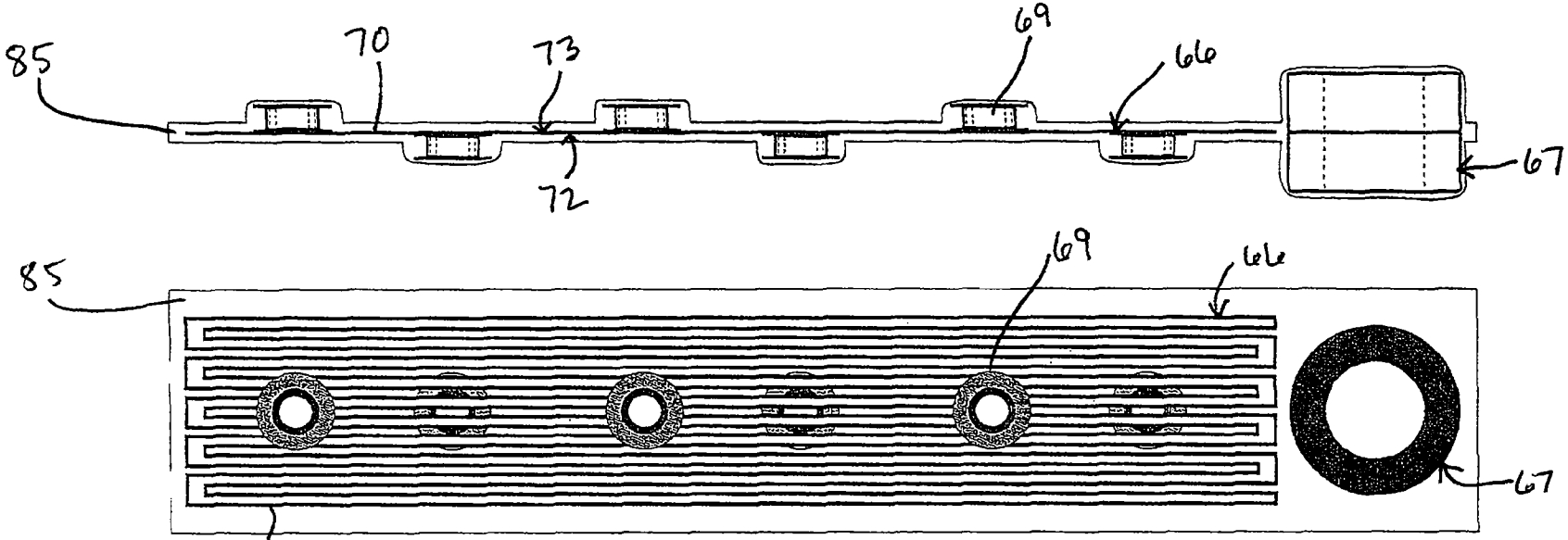
FIG. 5 shows a cross-section and a plan view of the transmission members of the fuel treatment unit according to the disclosed subject matter.

FIG. 5 shows the transmission members 66 and 67 in the liner cavity 85 both in cross-section and also in plan view. It can be seen from the plan view of FIG. 5 that the line 70 extends in a meander configuration so that a bottom side 72 and a top side 73 are formed. On the bottom side 72 and the top side 73 there are produced the coils 69, three coils 69 on each of the bottom side 72 and the top side 73, as seen in FIG. 5. Each of the coils 69 accommodates a number of turns, for example 30 turns, of a continuous wire. The continuous wire may be, for example, 0.8 $mm^2$ copper so that six series-connected coils are formed.

As already described, a transmission member 67 is connected upstream of the line 70. The transmission member 67 may include a transformer that preferably has a turn ratio of 13:1. The respective 13 turns may be comprised of a 0.8 $mm^2$ copper wire, or if the transformer has a turn ratio of one turn, the turn may be comprised of a 1.5 $mm^2$ copper wire with the one turn being electrically connected to the line 70.

As illustrated in the cross-section view in FIG. 5, the transmission members 66 and 67 are enclosed in the liner cavity 85, which may be a GRP (glass fiber reinforced plastic) lamination that in turn stabilizes the entire fuel treatment unit 20. For further stabilization, the transmission members 66 and 67 enclosed in the liner cavity 85 may be disposed in the interior of the fuel treatment unit 20 in a rail or other arrangement to avoid mechanical vibration of the fuel treatment unit 20. Such a configuration reliably prevents the transmission members 66 and 67 enclosed in the liner cavity 85 from knocking against the wall in the interior of the fuel treatment unit 20.

Figure 6:
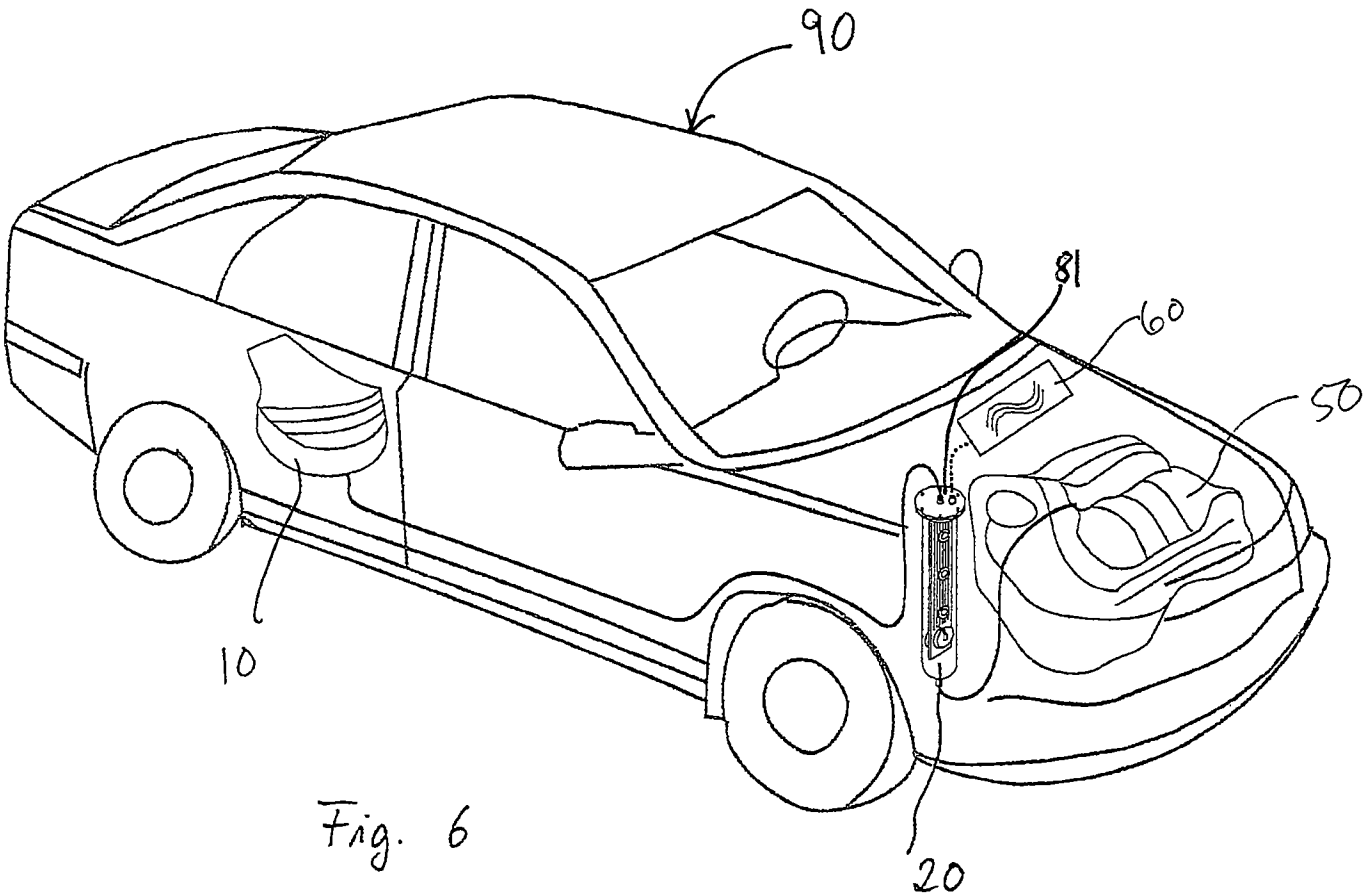
FIG. 6 shows a typical installation position of the fuel treatment system according to the disclosed subject matter in a vehicle, Table 1 shows an overview of the assessment of various measurements taken in a vehicle implementing the disclosed method and system, and Tables 2 through 7 show specific test reports of a vehicle implementing the disclosed method and system (exhaust gas testing Hannover; TÜV Nord).

FIG. 6 shows a typical installation of the apparatus in a vehicle 90 according to the disclosed subject matter. It should be noted that the fuel treatment unit 20 according to the disclosed subject matter is arranged in a vertical orientation in the engine compartment of the vehicle 90. The vertical orientation allows the fuel to flow downwardly through the cover 81 into the interior of the fuel treatment unit 20. After treatment of the fuel, as described above, the fuel leaves the fuel treatment unit 20 from the lower part of the fuel treatment unit 20 and is fed to the engine 50.

When the apparatus according to the disclosed subject matter is operated within the frequencies referred to in FIG. 3, it is possible to achieve a considerable reduction in the particles that are usually found in exhaust gases, such as the fine dust and soot. Measurements taken from a vehicle implementing the method and apparatus according to the disclosed subject matter demonstrate a reduction in the particles of 76.8% in comparison with a vehicle using untreated fuel. Additionally, the fuel consumption of the vehicle implementing the method and apparatus according to the disclosed subject matter was reduced by about 2.3%, the occurrence of carbon dioxide was reduced by 2.3%, and the occurrence of carbon monoxide was reduced by 1.4%. The chlorinated hydrocarbons were also reduced by 30.9%.

According to a preferred embodiment, not only are electromagnetic signals that remain the same generated, but at least a part of the electromagnetic signals in the form of transverse waves and another part in the form of longitudinal waves are also generated.

Table 3 shows such an example for the treatment of diesel (of a diesel vehicle). The left-hand side of Table 3 specifies in two columns various frequencies, namely the left-hand column shows the electromagnetic waves (signals) with their frequency detail which generate a transverse wave while the right hand column therebeside shows the waves (signals) with their frequency values which generate a longitudinal wave.

For clarification purposes it should be pointed out that a transverse wave (also referred to as shear wave) is a physical wave in which an oscillation occurs perpendicularly to its direction of propagation. A longitudinal wave in contrast is a physical wave which oscillates in the direction of propagation and a longitudinal wave always requires a medium (for example also the fuel) in order to advance. A known example of a longitudinal wave is otherwise sound in air or water, while an example of a transverse wave is a water wave which is a hybrid form of longitudinal waves and transverse waves.

The further Tables present test protocols for demonstrating the success of pollutant avoidance by the measures according to the disclosed subject matter. The measurements were taken by a neutral organization, which in turn had no knowledge of what was specifically fitted in the vehicle, the measurements were made like usual gas measurement procedures.

The various embodiments described above can be combined to provide further embodiments. All of the U.S. patents, U.S. patent application publications, U.S. patent application, foreign patents, foreign patent application and non-patent publications referred to in this specification and/or listed in the Application Data Sheet are incorporated herein by reference, in their entirety. Aspects of the embodiments can be modified, if necessary to employ concepts of the various patents, application and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

TABLE 1

TÜV Nord
Mobilität
Exhaust gas measurements according to 70/220/EEC in the version 98/69/EC
Consumption calculation in accordance with 80/1268/EEC in the version 199/100/EC
Order no: 06.3512
Manufacturer: DAIMLERCHRYSLER
Vehicle ID: WDB9067131S175508
Official identification: AUR-EC 609
Sprinter "new" OM 646.985 with DPF

| Test no | Comments | HCc [g/km] | CO [g/km] | CO2 [g/km] | NOx [g/km] | Particles [g/km] | Consumption [1/100 m] |
|---|---|---|---|---|---|---|---|
| | | | without modification | | | | |
| Mean value | | 0.022 | 0.031 | 285.802 | 0.317 | 0.011 | 10.813 |
| Min | | 0.020 | 0.031 | 285.390 | 0.309 | 0.002 | 10.797 |
| Max | | 0.023 | 0.031 | 286.418 | 0.325 | 0.021 | 10.836 |
| Man − Min | | 0.002 | 0.000 | 1.028 | 0.017 | 0.019 | 0.039 |
| Standard deviation | | 0.0012 | 0.0001 | 0.5437 | 0.0084 | 0.0095 | 0.0204 |
| | | | with modification | | | | |
| Mean value | | 0.015 | 0.031 | 279.129 | 0.334 | 0.003 | 10.559 |
| Min | | 0.014 | 0.026 | 278.140 | 0.324 | 0.002 | 10.522 |
| Max | | 0.017 | 0.039 | 280.357 | 0.339 | 0.003 | 10.606 |
| Man − Min | | 0.002 | 0.013 | 2.217 | 0.015 | 0.001 | 0.084 |
| Standard deviation | | 0.0013 | 0.0071 | 1.1272 | 0.0083 | 0.0004 | 0.0429 |
| Differences | | | | | | | |
| "with" as against "without" modification | | | −30.9 | −1.4 | −2.3 | 5.3 | −76.8 | −2.3 | [%] |
| Limit consideration | | | | | | | |
| "without" mean value − standard deviation | | | 0.021 | 0.031 | 285.258 | 0.309 | 0.002 | 10.792 | |
| "with" mean value − standard deviation | | | 0.014 | 0.024 | 278.002 | 0.326 | 0.002 | 10.516 | |
| | | | −33.4 | −23.8 | −2.5 | 5.4 | 41.9 | −2.6 | [%] |
| "without" mean value + standard deviation | | | 0.023 | 0.031 | 286.345 | 0.326 | 0.021 | 10.833 | |
| "with" mean value + standard deviation | | | 0.016 | 0.038 | 280.257 | 0.342 | 0.003 | 10.602 | |
| | | | −28.6 | 20.8 | −2.1 | 5.1 | −85.7 | −2.1 | [%] |
| "without" mean value − standard deviation | | | 0.021 | 0.031 | 285.258 | 0.309 | 0.002 | 10.792 | |
| "with" mean value + standard deviation | | | 0.016 | 0.038 | 280.257 | 0.342 | 0.003 | 10.602 | |
| | | | −20.5 | 21.9 | −1.8 | 10.8 | 92.0 | −1.8 | [%] |
| "without" mean value + standard deviation | | | 0.023 | 0.031 | 286.345 | 0.326 | 0.021 | 10.833 | |
| "with" mean value − standard deviation | | | 0.014 | 0.024 | 278.002 | 0.326 | 0.002 | 10.516 | |
| | | | −40.2 | −24.4 | −2.9 | 0.0 | −89.4 | −2.9 | [%] |

TABLE 2

TÜV Nord Mobilität GmbH & Co. KG
Institut für Fahrzeugtechnik und Mobilität
Antrieb Emissionen
30519 Hannover * Am TÜV 1
Exhaust gas testing Hannover
Tel. 0511/986-1591 * Fax 0511/986-1999

TÜV Nord
Mobilität

Test protocol

Hannover, 05.09.2007
20070905-0201

| | | | |
|---|---|---|---|
| Order no | 06.3512 | | |
| Vehicle ID | WDB9067131S175508 | Fuel density | 0.8338 kg/l |
| Official identification | AUR EC 609 | Kilometers | 15399 km |
| Manufacturer | DAIMLERCHRYSLER | Test weight | 2540 kg |
| | | Inertia weight | 2270 kg |
| Tire size | 235/65 R 16 C | Coefficients(f0/f1/f2) | 9.5/0/0.0646 |
| Tester | Mr Wohlrab | Expert | Mr Friedrich |
| Driver | Mr Kozlik | | |
| Comment | Sprinter 211CDI: Measurement I without modification | | |

| | Oil temp before text 22.3° C. Phase 1 | Oil temp after test 104.6° C. Phase 2 |
|---|---|---|
| Air pressure | 1019.43 hPa | 1019.50 hPa |
| Room temp dry | 22.2° C. | 22.8° C. |
| Rel. humidity | 40.3% | 37.0% |
| Absolute humidity | 6.66 g/kg air | 6.30 g/kg air |
| Humidity corr. Factor | 0.8825 | 0.8733 |
| Distance roller | 4065.73 m | 6971.45 m |

TABLE 2-continued

| | | | | |
|---|---|---|---|---|
| Power average value | 30.26 N | | 282.99 N | |
| Volume | 118.67 m3 | | 60.11 m3 | |
| Dilution | 19.624 | | 9.338 | |
| Bag values | Exhaust gas vpm | Air vpm | Exhaust gas vpm | Air vpm |
| HCc modal | 5.16 | 2.57 | 3.41 | 2.48 |
| CO | 2.73 | 0.46 | 0.43 | 0.38 |
| CO2 | 6820.468 | 407.388 | 14346.701 | 409.894 |
| NO*x* | 6.80 | 0.10 | 18.29 | 0.07 |
| Result | g/phase | g/km | g/phase | g/km |
| HCc modal | 0.200 | 0.049 | 0.044 | 0.006 |
| CO | 0.341 | 0.084 | 0.006 | 0.001 |
| CO2 | 1499.457 | 368.804 | 1650.443 | 236.743 |
| NO*x* | 1.441 | 0.354 | 1.965 | 0.282 |
| Particles | 0.018 | 0.004 | 0.102 | 0.015 |
| Consumption | | 13.96 l/100 km | | 8.95 l/100 km |

| Final result | | | with worsening factor | limit values 98/69/ECB; III | result |
|---|---|---|---|---|---|
| HCc modal | g/km | 0.022 | 0.022 | — | |
| CO | g/km | 0.031 | 0.035 | 0.74 | I.O. |
| CO2 | g/km | 285.390 | — | — | |
| NO*x* | g/km | 0.309 | 0.309 | 0.39 | I.O. |
| Particles | g/km | 0.0109 | 0.0131 | 0.06 | I.O. |
| HCc + NO*x* | g/km | 0.331 | 0.331 | 0.46 | I.O. |
| Consumption | l/100 km | 10.80 | | | 9.26 km/l |

TABLE 3

TÜV Nord Mobilität GmbH & Co. KG
Institut für Fahrzeugtechnik und Mobilität
Antrieb Emissionen
30519 Hannover * Am TÜV 1
Exhaust gas testing Hannover
Tel. 0511/986-1591 * Fax 0511/986-1999

TÜV Nord Mobilität

| | | | |
|---|---|---|---|
| Test protocol | | | Hannover, 06.09.2007<br>20070906-0202 |
| Order no | 06.3512 | | |
| Vehicle ID | WDB9067131S175508 | Fuel density | 0.8338 kg/l |
| Official identification | AUR EC 609 | Kilometers | 15410 km |
| Manufacturer | DAIMLERCHRYSLER | Test weight | 2540 kg |
| | | Inertia weight | 2270 kg |
| Tire size | 235/65 R 16 C | Coefficients(f0/f1/f2) | 9.5/0/0.0646 |
| Tester | Mr Wohlrab | Expert | Mr Friedrich |
| Driver | Mr Kozlik | | |
| Comment | Sprinter 211CDI: Measurement II without modification | | |

| | Oil temp before text 22.0° C.<br>Phase 1 | | Oil temp after test 104.9° C.<br>Phase 2 | |
|---|---|---|---|---|
| Air pressure | 1017.78 hPa | | 1017.75 hPa | |
| Room temp dry | 22.1° C. | | 22.8° C. | |
| Rel. humidity | 49.5% | | 45.7% | |
| Absolute humidity | 8.15 g/kg air | | 7.86 g/kg air | |
| Humidity corr. Factor | 0.9225 | | 0.9142 | |
| Distance roller | 4041.41 m | | 6976.25 m | |
| Power average value | 30.46 N | | 283.78 N | |
| Volume | 118.39 m3 | | 59.99 m3 | |
| Dilution | 19.604 | | 9.302 | |
| Bag values | Exhaust gas vpm | Air vpm | Exhaust gas vpm | Air vpm |
| HCc modal | 4.35 | 1.86 | 2.58 | 1.85 |
| CO | 2.63 | 0.31 | 0.30 | 0.33 |
| CO2 | 6828.254 | 395.800 | 14402.685 | 395.934 |
| NO*x* | 6.88 | 0.06 | 17.54 | 0.06 |

TABLE 3-continued

| Result | g/phase | g/km | g/phase | g/km |
|---|---|---|---|---|
| HCc modal | 0.190 | 0.047 | 0.035 | 0.005 |
| CO | 0.346 | 0.086 | 0.001 | 0.000 |
| CO2 | 1500.379 | 371.251 | 1655.277 | 237.273 |
| NO*x* | 1.530 | 0.379 | 1.969 | 0.282 |
| Particles | 0.005 | 0.001 | 0.013 | 0.002 |
| Consumption | | 14.05 l/100 km | | 8.97 l/100 km |

| Final result | | | with worsening factor | limit values 98/69/ECB; III | result |
|---|---|---|---|---|---|
| HCc modal | g/km | 0.020 | 0.020 | — | |
| CO | g/km | 0.031 | 0.035 | 0.74 | I.O. |
| CO2 | g/km | 286.418 | — | — | — |
| NO*x* | g/km | 0.318 | 0.318 | 0.39 | I.O. |
| Particles | g/km | 0.0016 | 0.0019 | 0.06 | I.O. |
| HCc + NO*x* | g/km | 0.338 | 0.338 | 0.46 | I.O. |
| Consumption | l/100 km | 10.84 | 9.23 km/l | | |

TABLE 4

TÜV Nord Mobilität GmbH & Co. KG
Institut für Fahrzeugtechnik und Mobilität
Antrieb Emissionen
30519 Hannover * Am TÜV 1
Exhaust gas testing Hannover
Tel. 0511/986-1591 * Fax 0511/986-1999

TÜV Nord Mobilität

Test protocol — Hannover, 07.09.2007
20070907-0201

| | | | |
|---|---|---|---|
| Order no | 06.3512 | | |
| Vehicle ID | WDB9067131S175508 | Fuel density | 0.8338 kg/l |
| Official identification | AUR EC 609 | Kilometers | 15421 km |
| Manufacturer | DAIMLERCHRYSLER | Test weight | 2540 kg |
| | | Inertia weight | 2270 kg |
| Tire size | 235/65 R 16 C | Coefficients(f0/f1/f2) | 9.5/0/0.0646 |
| Tester | Mr Wohlrab | Expert | Mr Friedrich |
| Driver | Mr Kozlik | | |
| Comment | Sprinter 211CDI: Measurement III without modification | | |

| | Oil temp before text 22.3° C. Phase 1 | Oil temp after test 104.6° C. Phase 2 |
|---|---|---|
| Air pressure | 1017.66 hPa | 1017.67 hPa |
| Room temp dry | 22.7° C. | 23.2° C. |
| Rel. humidity | 49.2% | 47.7% |
| Absolute humidity | 8.37 g/kg air | 8.37 g/kg air |
| Humidity corr. Factor | 0.9285 | 0.9285 |
| Distance roller | 4072.92 m | 6973.65 m |
| Power average value | 30.65 N | 282.36 N |
| Volume | 118.62 m3 | 60.01 m3 |
| Dilution | 19.555 | 9.333 |

| Bag values | Exhaust gas vpm | Air vpm | Exhaust gas vpm | Air vpm |
|---|---|---|---|---|
| HCc modal | 4.91 | 2.16 | 2.97 | 2.12 |
| CO | 2.68 | 0.37 | 0.26 | 0.30 |
| CO2 | 6844.894 | 403.202 | 14354.933 | 403.708 |
| NO*x* | 6.84 | 0.01 | 17.92 | 0.01 |

| Result | g/phase | g/km | g/phase | g/km |
|---|---|---|---|---|
| HCc modal | 0.210 | 0.051 | 0.040 | 0.006 |
| CO | 0.345 | 0.085 | 0.000 | 0.000 |
| CO2 | 1505.466 | 369.628 | 1649.406 | 236.520 |
| NO*x* | 1.545 | 0.379 | 2.049 | 0.294 |
| Particles | 0.228 | 0.056 | 0.000 | 0.000 |
| Consumption | | 13.99 l/100 km | | 8.95 l/100 km |

TABLE 4-continued

| Final result | | | with worsening factor | limit values 98/69/ECB; III | result |
|---|---|---|---|---|---|
| HCc modal | g/km | 0.023 | 0.023 | — | — |
| CO | g/km | 0.031 | 0.034 | 0.74 | I.O. |
| CO2 | g/km | 285.597 | — | — | — |
| NO*x* | g/km | 0.325 | 0.325 | 0.39 | I.O. |
| Particles | g/km | 0.0206 | 0.0247 | 0.06 | I.O. |
| HCc + NO*x* | g/km | 0.348 | 0.348 | 0.46 | I.O. |
| Consumption | l/100 km | 10.80 | | | 9.26 km/l |

TABLE 5

| | |
|---|---|
| TÜV Nord Mobilität GmbH & Co. KG<br>Institut für Fahrzeugtechnik und Mobilität<br>Antrieb Emissionen<br>30519 Hannover * Am TÜV 1<br>Exhaust gas testing Hannover<br>Tel. 0511/986-1591 * Fax 0511/986-1999 | TÜV Nord<br>Mobilität |

| | | | |
|---|---|---|---|
| Test protocol | | | Hannover, 18.09.2007<br>20070918-0205 |
| Order no | 06.3512 | | |
| Vehicle ID | WDB9067131S175508 | Fuel density | 0.8338 kg/l |
| Official identification | AUR EC 609 | Kilometers | 16586 km |
| Manufacturer | DAIMLERCHRYSLER | Test weight | 2540 kg |
| | | Inertia weight | 2270 kg |
| Tire size | 235/65 R 16 C | Coefficients(f0/f1/f2) | 9.5/0/0.0646 |
| Tester | Mr Wohlrab | Expert | Mr Friedrich |
| Driver | Mr Kozlik | | |
| Comment | Sprinter 211CDI: Measurement I with modification | | |

| | Oil temp before text 21.7° C.<br>Phase 1 | Oil temp after test 65.3° C.<br>Phase 2 |
|---|---|---|
| Air pressure | 1004.29 hPa | 1004.51 hPa |
| Room temp dry | 22.9° C. | 24.1° C. |
| Rel. humidity | 43.2% | 38.5% |
| Absolute humidity | 7.56 g/kg air | 7.22 g/kg air |
| Humidity corr. Factor | 0.9062 | 0.8970 |
| Distance roller | 4072.66 m | 6983.74 m |
| Power average value | 30.39 N | 283.96 N |
| Volume | 117.09 m3 | 59.19 m3 |
| Dilution | 19.881 | 9.260 |

| Bag values | Exhaust gas vpm | Air vpm | Exhaust vpm | gas Air vpm |
|---|---|---|---|---|
| HCc modal | 3.47 | 1.85 | 2.56 | 1.78 |
| CO | 3.22 | 0.29 | 0.26 | 0.27 |
| CO2 | 6733.391 | 400.558 | 14468.596 | 403.564 |
| NO*x* | 7.09 | 0.00 | 18.65 | 0.00 |

| Result | g/phase | g/km | g/phase | g/km |
|---|---|---|---|---|
| HCc modal | 0.124 | 0.031 | 0.035 | 0.005 |
| CO | 0.431 | 0.106 | 0.001 | 0.000 |
| CO2 | 1460.999 | 358.294 | 1640.137 | 234.851 |
| NO*x* | 1.552 | 0.381 | 2.035 | 0.291 |
| Particles | 0.011 | 0.003 | 0.021 | 0.003 |
| Consumption | | 13.56 l/100 km | | 8.88 l/100 km |

| Final result | | | with worsening factor | limit values 98/69/ECB; III | result |
|---|---|---|---|---|---|
| HCc modal | g/km | 0.014 | | | |
| CO | g/km | 0.039 | 0.043 | 0.740 | I.O. |
| CO2 | g/km | 280.357 | | | |
| NO*x* | g/km | 0.324 | 0.324 | 0.390 | I.O. |
| Particles | g/km | 0.0029 | 0.004 | 0.060 | I.O. |
| HCc + NO*x* | g/km | 0.339 | 0.339 | 0.460 | I.O. |
| Consumption | l/100 km | 10.61 | | | 9.43 km/l |

TABLE 6

| | |
|---|---|
| TÜV Nord Mobilität GmbH & Co. KG<br>Institut für Fahrzeugtechnik und Mobilität<br>Antrieb Emissionen<br>30519 Hannover * Am TÜV 1<br>Exhaust gas testing Hannover<br>Tel. 0511/986-1591 * Fax 0511/986-1999 | TÜV Nord<br>Mobilität |

| | | | |
|---|---|---|---|
| Test protocol | | | Hannover, 19.09.2007<br>20070919-0206 |
| Order no | 06.3512 | | |
| Vehicle ID | WDB9067131S175508 | Fuel density | 0.8338 kg/l |
| Official identification | AUR EC 609 | Kilometers | 16597 km |
| Manufacturer | DAIMLERCHRYSLER | Test weight | 2540 kg |
| | | Inertia weight | 2270 kg |
| Tire size | 235/65 R 16 C | Coefficients(f0/f1/f2) | 9.5/0/0.0646 |
| Tester | Mr Wohlrab | Expert | Mr Friedrich |
| Driver | Mr Kozlik | | |
| Comment | Sprinter 211CDI: Measurement II with modification | | |

| | Oil temp before text 22.0° C.<br>Phase 1 | Oil temp after test 64.8° C.<br>Phase 2 |
|---|---|---|
| Air pressure | 1014.23 hPa | 1014.19 hPa |
| Room temp dry | 22.9° C. | 23.5° C. |
| Rel. humidity | 41.8% | 37.5% |
| Absolute humidity | 7.24 g/kg air | 6.72 g/kg air |
| Humidity corr. Factor | 0.8974 | 0.8841 |
| Distance roller | 4072.28 m | 6979.30 m |
| Power average value | 30.64 N | 283.86 N |
| Volume | 95.59 m3 | 48.35 m3 |
| Dilution | 16.498 | 7.660 |

| Bag values | Exhaust gas vpm | Air vpm | Exhaust gas vpm | Air vpm |
|---|---|---|---|---|
| HCc modal | 4.06 | 2.08 | 2.79 | 2.05 |
| CO | 3.06 | 0.55 | 0.56 | 0.51 |
| CO2 | 8115.234 | 393.772 | 17489.342 | 393.896 |
| NO*x* | 9.67 | 0.00 | 23.23 | 0.00 |

| Result | g/phase | g/km | g/phase | g/km |
|---|---|---|---|---|
| HCc modal | 0.125 | 0.031 | 0.030 | 0.004 |
| CO | 0.303 | 0.074 | 0.007 | 0.001 |
| CO2 | 1454.078 | 357.067 | 1628.119 | 233.278 |
| NO*x* | 1.703 | 0.418 | 2.038 | 0.292 |
| Particles | 0.005 | 0.001 | 0.018 | 0.003 |
| Consumption | | 13.51 l/100 km | | 8.82 l/100 km |

| Final result | | | with worsening factor | limit values 98/69/ECB; III | result |
|---|---|---|---|---|---|
| HCc modal | g/km | 0.014 | — | — | — |
| CO | g/km | 0.028 | 0.031 | 0.740 | I.O. |
| CO2 | g/km | 278.892 | — | — | — |
| NO*x* | g/km | 0.339 | 0.339 | 0.390 | I.O. |
| Particles | g/km | 0.0022 | 0.003 | 0.060 | I.O. |
| HCc + NO*x* | g/km | 0.353 | 0.353 | 0.460 | I.O. |
| Consumption | l/100 km | 10.55 | | | 9.48 km/l |

TABLE 7

| | |
|---|---|
| TÜV Nord Mobilität GmbH & Co. KG<br>Institut für Fahrzeugtechnik und Mobilität<br>Antrieb Emissionen<br>30519 Hannover * Am TÜV 1<br>Exhaust gas testing Hannover<br>Tel. 0511/986-1591 * Fax 0511/986-1999 | TÜV Nord<br>Mobilität |

| | | | |
|---|---|---|---|
| Test protocol | | | Hannover, 20.09.2007<br>20070920-0206 |
| Order no | 06.3512 | | |
| Vehicle ID | WDB9067131S175508 | Fuel density | 0.8338 kg/l |
| Official identification | AUR EC 609 | Kilometers | 16608 km |

TABLE 7-continued

| | | | |
|---|---|---|---|
| Manufacturer | DAIMLERCHRYSLER | Test weight | 2540 kg |
| | | Inertia weight | 2270 kg |
| Tire size | 235/65 R 16 C | Coefficients(f0/f1/f2) | 9.5/0/0.0646 |
| Tester | Mr Wohlrab | Expert | Mr Friedrich |
| Driver | Mr Kozlik | | |
| Comment | Sprinter 211CDI: Measurement III with modification | | |

| | Oil temp before text 22.3° C. Phase 1 | Oil temp after test 63.9° C. Phase 2 |
|---|---|---|
| Air pressure | 1012.62 hPa | 1012.70 hPa |
| Room temp dry | 22.1° C. | 22.9° C. |
| Rel. humidity | 40.5% | 38.8% |
| Absolute humidity | 6.68 g/kg air | 6.70 g/kg air |
| Humidity corr. Factor | 0.8829 | 0.8835 |
| Distance roller | 4072.04 m | 6985.86 m |
| Power average value | 29.95 N | 283.82 N |
| Volume | 117.67 m3 | 59.70 m3 |
| Dilution | 20.108 | 9.378 |

| Bag values | Exhaust gas vpm | Air vpm | Exhaust gas vpm | Air vpm |
|---|---|---|---|---|
| HCc modal | 4.26 | 2.40 | 3.13 | 2.35 |
| CO | 2.92 | 1.05 | 0.87 | 1.02 |
| CO2 | 6656.892 | 419.304 | 14285.471 | 435.328 |
| NOx | 8.03 | 0.17 | 19.36 | 0.27 |

| Result | g/phase | g/km | g/phase | g/km |
|---|---|---|---|---|
| HCc modal | 0.144 | 0.035 | 0.038 | 0.005 |
| CO | 0.284 | 0.070 | 0.000 | 0.000 |
| CO2 | 1446.324 | 355.184 | 1629.321 | 233.231 |
| NOx | 1.677 | 0.412 | 2.071 | 0.296 |
| Particles | 0.010 | 0.002 | 0.019 | 0.003 |
| Consumption | | 13.44 l/100 km | | 8.82 l/100 km |

| Final result | | | with worsening factor | limit values 98/69/ECB; III | result |
|---|---|---|---|---|---|
| HCc modal | g/km | 0.017 | — | — | — |
| CO | g/km | 0.026 | 0.028 | 0.740 | I.O. |
| CO2 | g/km | 278.140 | — | — | — |
| NOx | g/km | 0.339 | 0.339 | 0.390 | I.O. |
| Particles | g/km | 0.0026 | 0.003 | 0.060 | I.O. |
| HCc + NOx | g/km | 0.355 | 0.355 | 0.460 | I.O. |
| Consumption | l/100 km | 10.52 | | | 9.50 km/l |

The invention claimed is:

1. A system comprising:

a fuel tank that stores fuel;

a fuel treatment unit that houses at least one transmission member, the at least one transmission member including a plurality of coils that are connected together and a flat line having a line that is arranged in a plane and extends in a meander configuration;

an electromagnetic signal generator coupled to the transmission member, the electromagnetic signal generator generating electromagnetic signals that are delivered to the transmission member housed in the fuel treatment unit so that the transmission member exposes the fuel to the electromagnetic signals to produce treated fuel; and an engine for receiving and using the treated fuel.

2. The system of claim 1, the electromagnetic signals including at least four signals at preset frequencies.

3. The system of claim 1, the electromagnetic signals include frequencies that are above 20 kHz.

4. The system of claim 1, the at least one transmission member being housed in a case, the case being housed in the fuel treatment unit and the case separating the transmission member from the fuel that is in the fuel treatment unit.

5. The system of claim 1, the fuel treatment unit being substantially hollow and of a substantially cylindrical shape, the fuel treatment unit comprising a fuel tank connection, an electromagnetic signal generator connection, and an engine connection.

6. The system of claim 1, the flat line having disposed on each side at least one coil from the plurality of coils, each of the at least one coil disposed on each side of the flat line being electrically connected.

7. The system of claim 1, the electromagnetic signals being delivered through at least one of the flat line and the plurality of coils.

8. The system of claim 1, wherein the at least one transmission member comprises a transformer that has a turn ratio of n:1, where n is a number between 2 and 100.

9. The system of claim 1, the plurality of coils having coil bodies that have a number of turns each between 5 and 100.

10. A method comprising:

passing fuel into a fuel treatment unit;

generating electromagnetic signals that have a frequency above 20 kHz;

using the electromagnetic signals in at least one transmission member housed inside the fuel treatment unit to obtain treated fuel, the at least one transmission member including a plurality of coils that are connected together and a flat line having a line that is arranged in a plane and extends in a meander configuration;

moving the treated fuel from the fuel treatment unit to an engine for combustion.

11. The method of claim 10, the electromagnetic signals include at least four signals at preset frequencies.

12. The method of claim 10, the electromagnetic signals have frequencies that are between 20 kHz and 67 kHz.

13. The method of claim 10, the electromagnetic signals include at least one of a transverse wave and a longitudinal wave.

* * * * *